US006561254B1

(12) United States Patent
Liu

(10) Patent No.: US 6,561,254 B1
(45) Date of Patent: May 13, 2003

(54) SLAT ANGLE ADJUSTING DEVICE FOR A VENETIAN BLIND

(76) Inventor: Tai-Ping Liu, No. 15, Alley 8, Lane 3, Kuo-Chi St., Lu-Ching Hsiang, Taichung Hsien (TW)

( * ) Notice: Subject to any disclaimer, the term of this patent is extended or adjusted under 35 U.S.C. 154(b) by 0 days.

(21) Appl. No.: 10/099,023

(22) Filed: Mar. 13, 2002

(51) Int. Cl.[7] ..... E06B 9/38
(52) U.S. Cl. ..... 160/177 R; 160/178.1 R
(58) Field of Search ..... 160/178.1 R, 177 R, 160/176.1 R, DIG. 902, 168.1 R, 168.1 V, 177 V, 178.1 V, 173 R, 173 V

(56) References Cited

U.S. PATENT DOCUMENTS 3,291,194 A * 12/1966 Kirkley et al.
3,357,270 A * 12/1967 Spangenberg
4,572,267 A * 2/1986 Stein et al.
5,031,681 A * 7/1991 Dodich
5,680,892 A * 10/1997 Liu

FOREIGN PATENT DOCUMENTS

AU 255438 * 9/1963
GB 938992 * 10/1963

* cited by examiner

*Primary Examiner*—Blair M. Johnson
(74) *Attorney, Agent, or Firm*—Alan Kamrath; Rider Bennett, LLP

(57) ABSTRACT

A slat angle adjusting device for a Venetian blind has a body, a roller, a transmission device, a positioning bar and a positioning plate. The roller is rotatably attached to the body for a cord being wound around the roller. The transmission device is received in the body and operationally connected to the roller. The positioning bar is integrally formed on the top of the body and has two ends adapted to engage with upper bent portions of a headrail of the Venetian blind. The positioning plate is pivotally attached to the top of the positioning bar and has at least two engaging elements for engaging with the upper bent portions of the headrail. With such an adjusting device, the positioning plate can provide a further positioning effect to the adjusting device to keep the body from sliding relative to the headrail.

6 Claims, 4 Drawing Sheets

SLAT ANGLE ADJUSTING DEVICE FOR A VENETIAN BLIND

BACKGROUND OF THE INVENTION

1. Field of the Invention

The present invention relates to an angle adjusting device, and more particularly to a slat angle adjusting device for a Venetian blind and having a positioning plate.

2. Description of Related Art

With reference to FIG. 4, a conventional slat angle adjusting device (50) for a Venetian blind in accordance with the prior art comprises a body, and a roller (56). The body is securely positioned to the headrail (70) of the Venetian blind for the tilt rod (72) extending through the body. A transmission device (not shown) is arranged in the body and is connected to the tilt rod (72). The roller (56) is rotatably attached to the body and is operationally connected to the transmission device. A cord (60) is wound around the roller (56) and has two ends extending through a base (54) and the headrail (70). When the user pulls the cord (60), the tilt rod (72) will rotate through the transmissions of the roller (56) and the transmission device. Consequently, the angle of the slats of the Venetian blind will be adjusted.

To securely position the body to the headrail (70), a positioning bar (52) is formed on the top of the body and has two C-shaped ends adapted for engaging two upper bent portions of the headrail (70). However, it is found that the positioning effect provided by the positioning bar (52) is not enough for common use. When the user pulls the cord (60) with a large force, the body can slide along the headrail (70) and the position of the adjusting device (50) is changed.

To overcome the shortcomings, the present invention tends to provide a slat angle adjusting device to mitigate or obviate the aforementioned problems.

SUMMARY OF THE INVENTION

The main objective of the invention is to provide a slat angle adjusting device for a Venetian blind to keep the slat angle adjusting device from sliding relative to the headrail of the Venetian blind. The slat angle adjusting device has a body, a roller, a transmission device, a positioning bar and a positioning plate. The roller is rotatably attached to the body for a cord being wound around the roller. The transmission device is received in the body and operationally connected to the roller. The positioning bar is integrally formed on the top of the body and has two ends adapted to engage with upper bent portions of a headrail of the Venetian blind. The positioning plate is pivotally attached to the top of the positioning bar. At least two engaging elements are formed on the positioning plate and are adapted to engage with the upper bent portions of the headrail. With such an adjusting device, the positioning plate can provide a further positioning effect to the adjusting device to keep the body from sliding relative to the headrail. The structural stability of the Venetian blind is improved.

Other objects, advantages and novel features of the invention will become more apparent from the following detailed description when taken in conjunction with the accompanying drawings.

DETAILED DESCRIPTION OF PREFERRED EMBODIMENT

Figure 1:
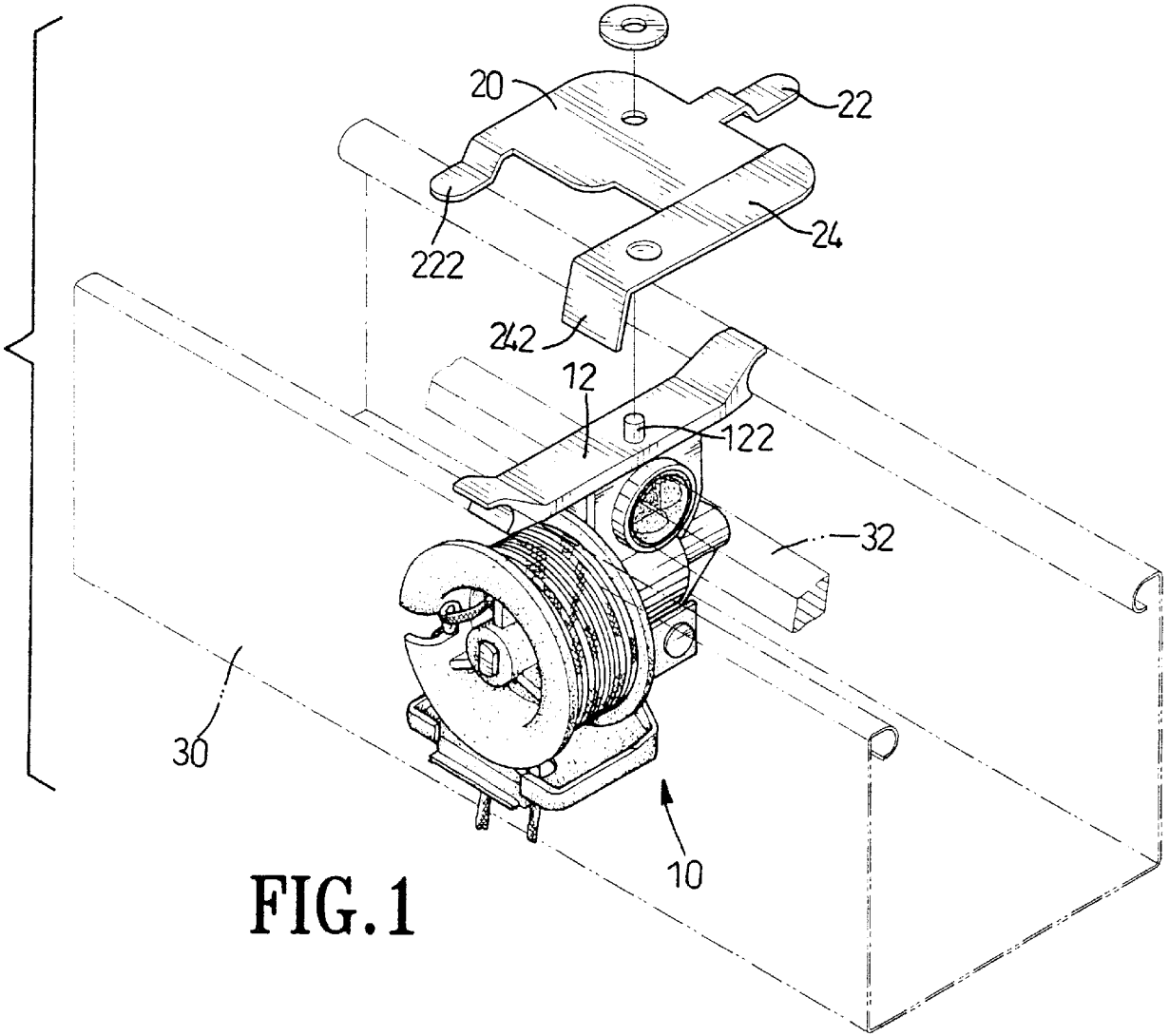
FIG. 1 is an exploded perspective view of a slat angle adjusting device in accordance with the present invention.
Figure 2:
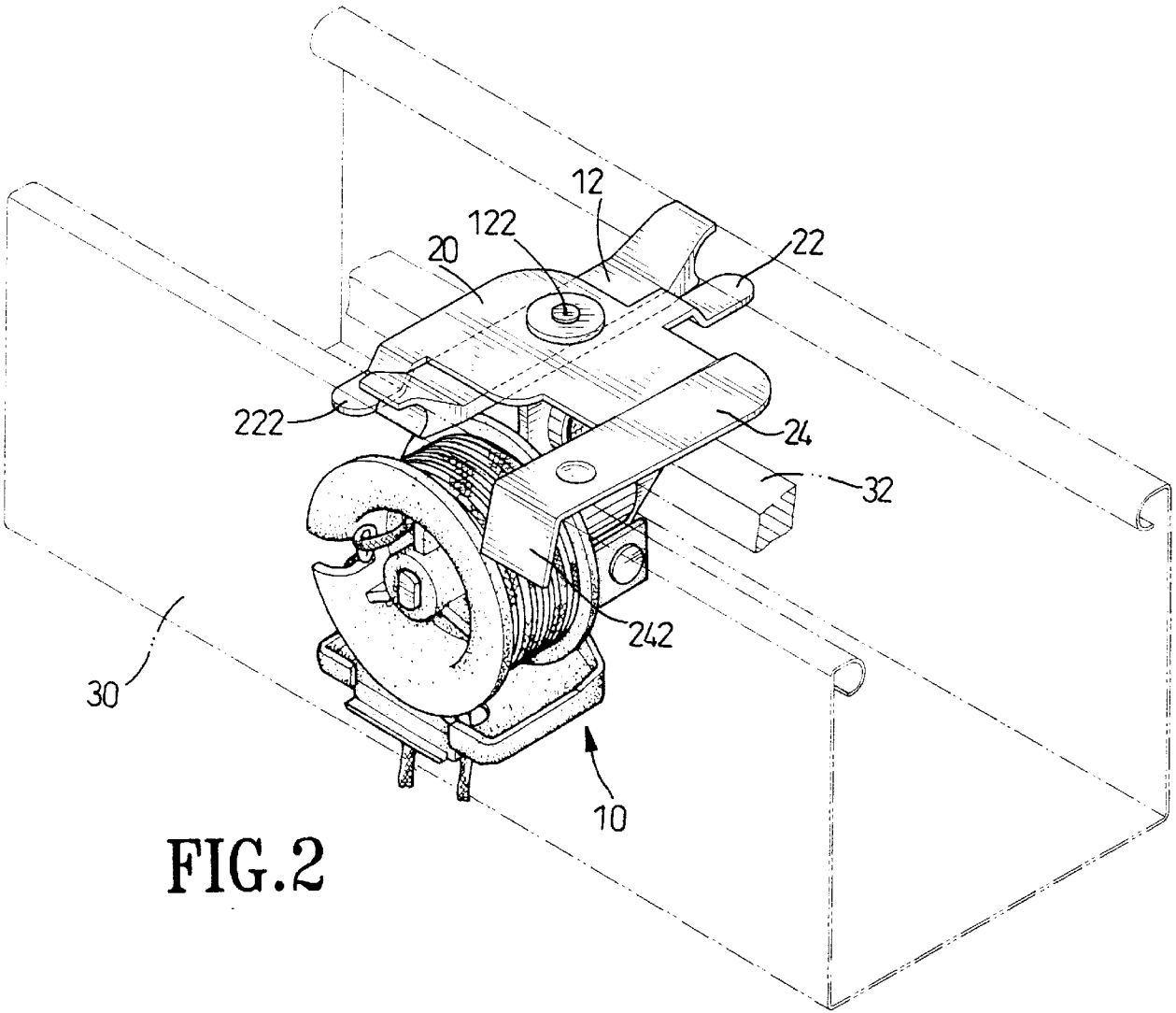
FIG. 2 is a perspective view of the slat angle adjusting device in FIG. 1.
Figure 3:
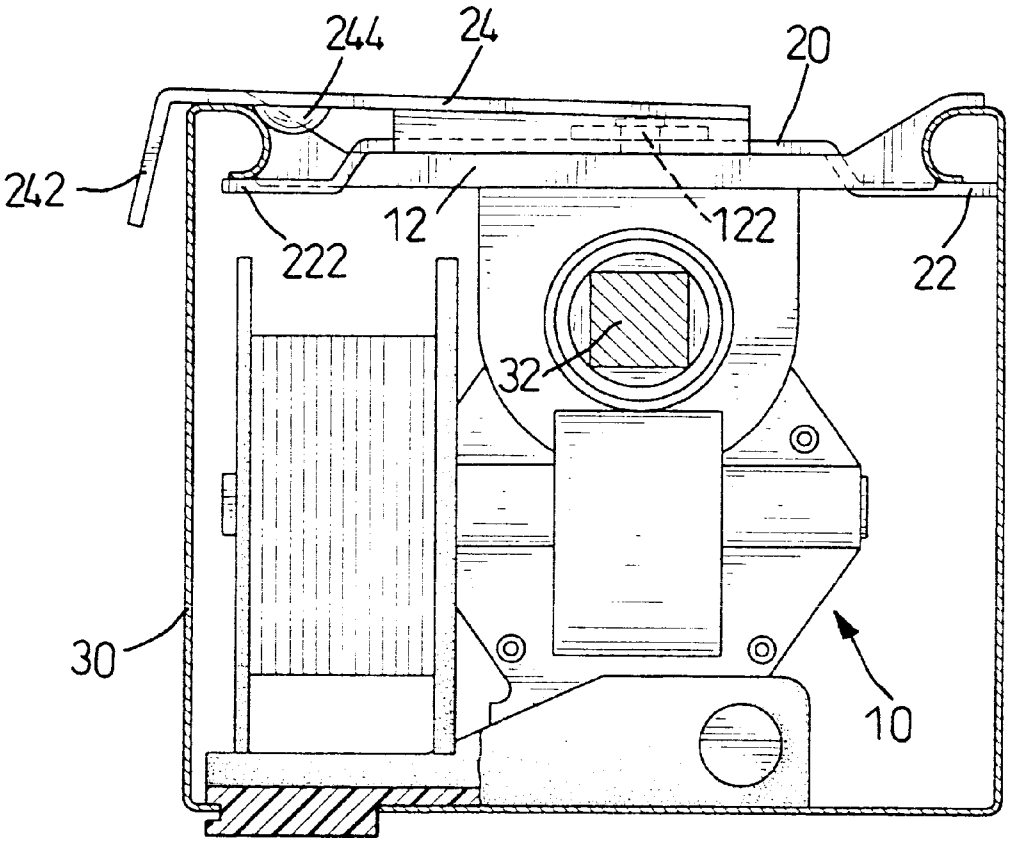
FIG. 3 is a side plan view in partial cross section of a headrail with the slat angle adjusting device in FIG. 1.
Figure 4:
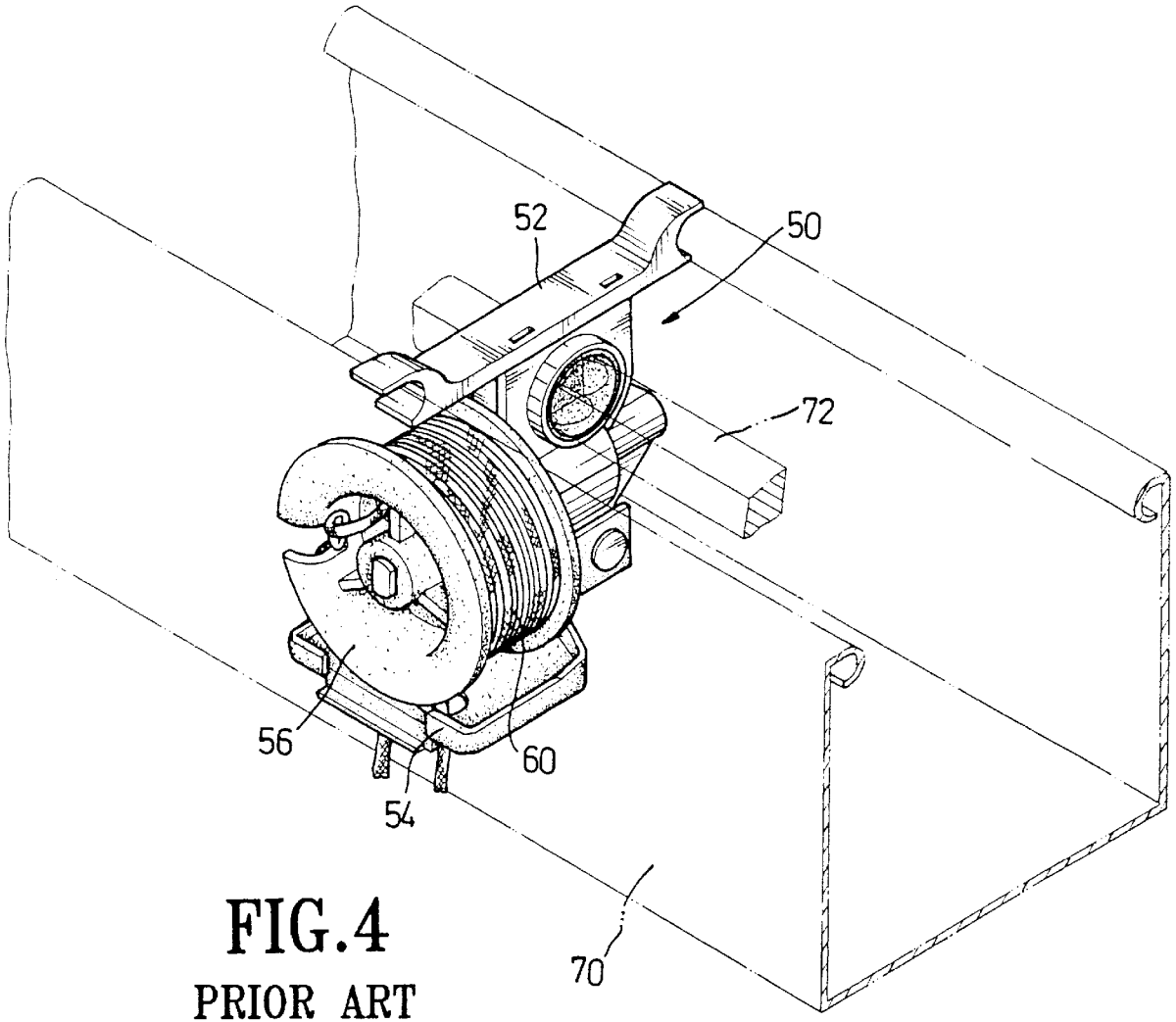
FIG. 4 PRIOR ART
FIG. 4 is a perspective view of a conventional slat angle adjusting device in accordance with the prior art.

With reference to FIGS. 1 to 3, a slat angle adjusting device (10) for a Venetian blind in accordance with the present invention comprises a body, a positioning bar (12), a roller (not numbered), a transmission device (not shown) and a positioning plate (20). The body is hollow, and in practice, composed of two half covers. The positioning bar (12) is integrally formed on the top of the body and has two C-shaped ends for engaging with upper bent portions of a headrail (30) of the Venetian blind. With the positioning bar (12), the body is securely positioned in the headrail (30) of the Venetian blind. The roller is rotatably attached to the body for a cord (not numbered) being wound around the roller. The transmission device is mounted in the body and is operationally connected to the roller and the tilt rod (32) of the Venetian blind. Accordingly, when the cord is pulled, the tilt rod (32) will rotate through the transmissions of the roller and the transmission device.

The positioning plate (20) is pivotally attached to the top of the positioning bar (12). To pivotally attach the positioning plate (20) to the positioning bar (12), a stub (122) extends upward from the top of the positioning bar (12) and penetrates a through hole defined in the positioning plate (20). At least two engaging elements are formed on the positioning plate to engage with the upper bent portions of the headrail (30). In practice, the engaging elements comprise a lower engaging tab (22) and an upper engaging tab (24). The lower engaging tab (22) laterally extends from the positioning plate (20) and is adapted to abut against the bottom of one of the upper bent portions of the headrail (30). The upper engaging tab (24) is formed on one end of the positioning plate (20) and is adapted to engage with the top of the other upper bent portion of the headrail (30). A flange (242) inclinedly extends downward from one end of the upper engaging tab (24) and is adapted to abut the outer surface of the corresponding one of the upper bent portions of the headrail (30). A protrusion (244) integrally protrudes from the bottom of the upper engaging tab (24) and is adapted to abut the inner surface of the corresponding one of the upper bent portions of the headrail (30). Consequently, the upper engaging plate (24) can securely engage with the upper bent portion of the headrail (30) with the flange (242) and the protrusion (244).

In another embodiment, the engaging elements comprise two lower engaging tabs (22,222). The two lower engaging tabs (22,222) respectively extend from opposite sides of the positioning plate (20) and is respectively adapted to abut against the bottoms of the upper bent portions of the headrail (30).

In a third embodiment, the engaging elements comprise two lower engaging tabs (22,222) and an upper engaging tab (24) as shown in the figures.

After the body being positioned in the headrail (30) with the positioning bar (12), the positioning plate (20) is rotated to engage with the upper bent portions of the headrail (30) with the engaging elements. With the positioning plate (20), the body can be further positioned in the headrail (30). The body will not move relative to the headrail (30) even if the cord is pulled by a large force, and the structural stability of the Venetian blind is increased.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slat angle adjusting device for Venetian blind comprising:

a body;

a roller rotatably attached to the body for a cord being wound around the roller;

a transmission device received in the body and operationally connected to the roller;

a positioning bar integrally formed on a top of the body and having two ends adapted to engage with upper bent portions of a headrail of the Venetian blind; and a positioning plate pivotally attached to a top of the positioning bar and having at least two engaging elements adapted to engage with the upper bent portions of the headrail, wherein a stub extends upward from the top of the positioning bar for the positioning plate being pivotally attached to the stub.

2. The slat angle adjusting device as claimed in claim 1, wherein the engaging elements comprises:

a lower engaging tab laterally extending from the positioning plate and adapted to abut against a bottom of a first one of the upper bent portions of the headrail; and an upper engaging tab formed on one end of the positioning plate and adapted to engage with a top of a second one of the upper bent portions of the headrail.

3. The slat angle adjusting device as claimed in claim 2, wherein the upper engaging tab has:

a flange inclinedly extending downward from one end of the upper engaging tab and adapted to abut an outer surface of the corresponding one of the upper bent portions of the headrail; and a protrusion integrally protruding from a bottom of the upper engaging tab and adapted to abut an inner surface of the corresponding one of the upper bent portions of the headrail.

4. The slat angle adjusting device as claimed in claim 1, wherein the engaging elements comprise:

a first lower engaging tab laterally extending from the positioning plate and adapted to abut against a bottom of a first one of the upper bent portions of the headrail; and a second lower engaging tab laterally extending from the positioning plate and opposite to the first lower engaging tab to be adapted to abut against a bottom of a second one of the upper bent portions of the headrail.

5. The slat angle adjusting device as claimed in claim 1, wherein the engaging elements comprise:

a first lower engaging tab laterally extending from the positioning plate and adapted to abut against a bottom of a first one of the upper bent portions of the headrail;

a second lower engaging tab laterally extending from the positioning plate and opposite to the first lower engaging tab to be adapted to abut against a bottom of a second one of the upper bent portions of the headrail; and an upper engaging tab formed on one end of the positioning plate and adapted to engage with a top of one of the upper bent portions of the headrail.

6. The slat angle adjusting device as claimed in claim 5, wherein the upper engaging tab has:

a flange inclindedly extending downward from one end of the upper engaging tab and adapted to abut an outer surface of the corresponding one of the upper bent portions of the headrail; and a protrusion integrally protruding from a bottom of the upper engaging tab and adapted to abut an inner surface of the corresponding one of the upper bent portions of the headrail.

* * * * *